US005231818A

United States Patent [19]

Newman

[11] Patent Number: 5,231,818

[45] Date of Patent: Aug. 3, 1993

[54] EQUESTRIAN TRAINING AID

[76] Inventor: Frederica C. Newman, Ryalls Farm Ryalls La., Bishop's Caundle, Dorset DT9 5NG, England

[21] Appl. No.: 768,599

[22] PCT Filed: Mar. 19, 1990

[86] PCT No.: PCT/GB90/00414

§ 371 Date: Oct. 3, 1991

§ 102(e) Date: Oct. 3, 1991

[87] PCT Pub. No.: WO90/11966

PCT Pub. Date: Oct. 18, 1990

[30] Foreign Application Priority Data

Apr. 4, 1989 [GB] United Kingdom ..... 8907568

Aug. 31, 1989 [GB] United Kingdom ..... 8919673

[51] Int. Cl.[5] ..... B68B 1/00

[52] U.S. Cl. ..... 54/71; 54/6.1

[58] Field of Search ..... 54/6.1, 6.2, 24, 71; 119/107

[56] References Cited

U.S. PATENT DOCUMENTS

| | | | |
|---|---|---|---|
| 1,529,471 | 3/1925 | Edwards | 119/107 |
| 1,932,910 | 10/1933 | Powers | 119/107 X |
| 2,349,375 | 5/1944 | Ray | 54/6.1 |
| 3,306,005 | 2/1967 | Stafford | 54/6.1 |
| 4,813,213 | 3/1989 | Nicowski | 54/6.1 |

*Primary Examiner*—Robert P. Swiatek

*Attorney, Agent, or Firm*—Richard C. Litman

[57] ABSTRACT

An equestrian training aid comprises a chain 10, having spring clips 14, 15 for attachment to the side rings 12, 13 of a horse's bit 11. A plurality of weights 16, in the form of cylindrical bodies each with an axial hole, are carried on the chain, with the chain 10 threaded through the holes of the weights. The number and total mass of the weights are selected to impose a load on the horse's bit and bridle to encourage a desired carriage of the head and promote correct muscular development. The weights will be worn below the horse's jaw behind the chin. The effective length of the chain 16 can be varied by moving one or both of the clips to selected links of the chain, to suit the jaw width of individual horses. The weights may be enclosed in a resilient covering 17 and retained by a resilient disc at each end 18.

9 Claims, 3 Drawing Sheets

EQUESTRIAN TRAINING AID

Figure 1:
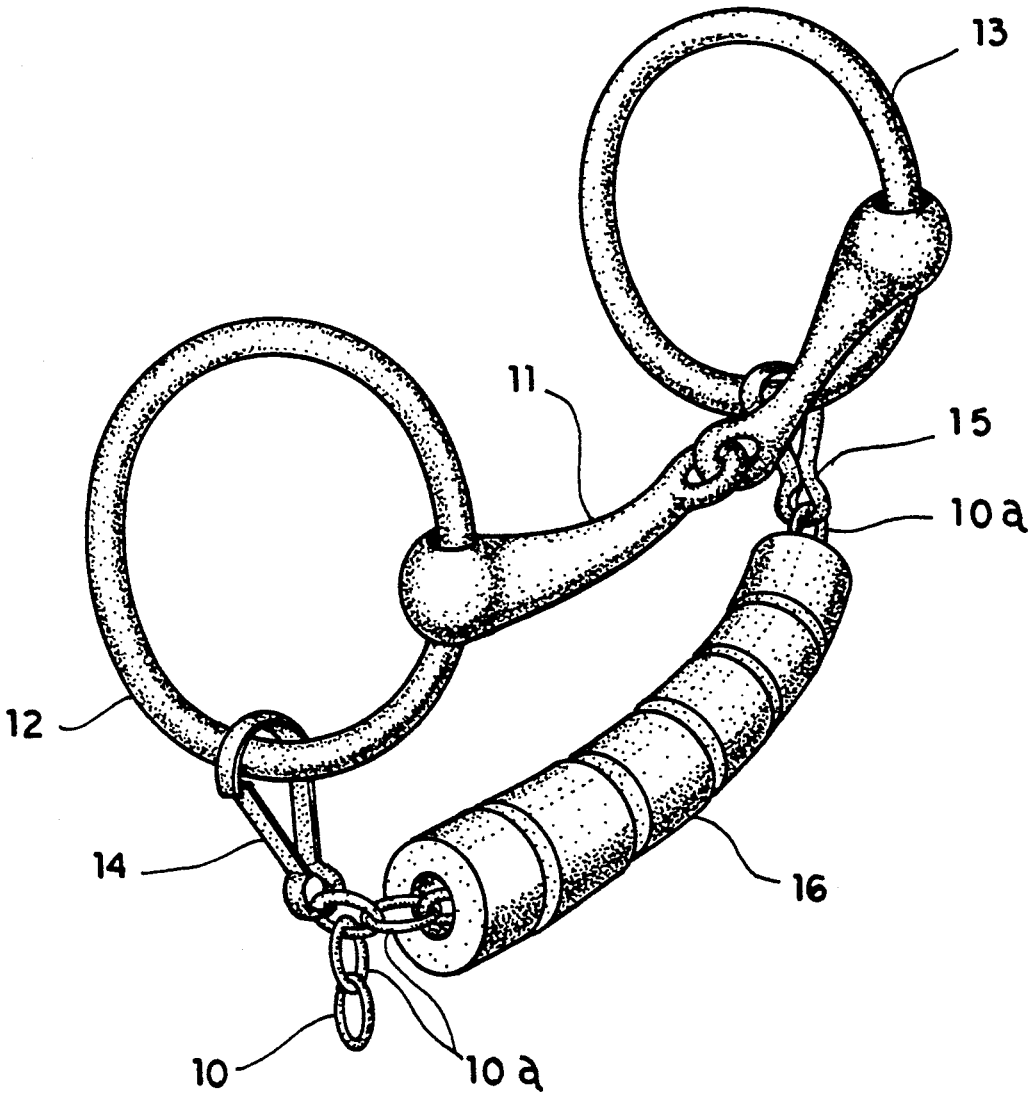

This invention relates to an equestrain training aid, specifically a gymnastic weight for encouraging correct head carriage, and promoting correct muscular development.

In training horses and ponies for the saddle, or draft, it is important for the animal to learn correct head carriage and bit contact, so that guidance given by the rider via the reins may be effective even when applied gently. With correct carriage, the mouth remains sensitive to the bit without pain, so that gently applied pressure will suffice to guide the horse. If the head is carried incorrectly, particularly too high and forward, the mouth becomes damaged and loses sensitivity due to scarring so that gentle guidance becomes difficult.

The head carriage can be influenced, both in riding and in lungeing (that is walking, trotting and cantering the horse in a circle on the end of a long rein held by the trainer who stands at the centre), by devices such as side reins, running reins, or martingales. Disadvantages of the martingale and its variants are that it restricts the natural head movements of the horse and when removed the horse is encouraged to resume its faulty head carriage, so that the martingale becomes a permanent necessity.

Side reins are a useful aid, but their main disadvantage is that being unyielding in tension, the head is unable to move forward beyond the fixed rein length when it would need to do so, e.g. for the horse to maintain its balance, and secondly, as they work only in tension, they do not prevent the horse from overbending to avoid contact on the bit. The first can be overcome partly by the use of elastic side reins, but the second cannot be overcome by any sort of rein, and at present no aid which avoids overbending is available. All present aids may be characterised as tensile restraints which the horse pulls against.

An object of the invention is to provide an equestrian training aid which will help to develop correct head carriage and contact on the bit which can avoid or overcome the disadvantages of martingales, side reins, and similar devices.

A second object of the invention is to promote and accelerate correct muscular development along the top line of the horse, i.e. the upper neck, withers and back. In standard training on the lunge the horse is encouraged by means of aids from the lunge line and whip to lower his head and neck during which the greatest activation of top line muscles occurs, in addition to which the act of raising and lowering the neck is achieved by the action of the same muscles thus promoting this development. This activity is not easily achieved by the trainer and often quite small periods of correct action occur during the lungeing session. The invention produces the required result without aids from the trainer.

A third object of the invention is to produce free forward going action, normally described as the horse working "through" correctly.

A fourth object of the invention is to encourage even and symmetrical action and posture. In common with all vertebrate animals, including man, horses are not naturally endowed with perfect bilateral symmetry. Consequently, unless corrected, they will move in a manner which favours the weaker areas, further accentuating the asymmetry to the detriment of the horses athletic ability and making him unpleasant to ride. The most noticeable manifestation of this problem is when horses bend the neck to carry the head to one side. This is particularly undesirable as even contact on the bit is not achieved making precise control impossible. In established training methods, the correction is achieved, or attempted, by subtle adjustments to the rider's seat and aids. This is difficult and is only achieved by expert, sensitive riders. The invention provides a corrective stimulus while the horse is lunged and may be used in a special manner to correct specific faults as described below.

A fifth object of the invention is to discourage tight grasping of the bit in the horses's jaws; a serious fault which, when learned, enables the horse to evade the rein aids and to "pull" and "bolt".

A sixth object of the invention is to encourage a lowering of the neck and consequential stretching of the top line. This reduces the load on the inter-vertebral discs and thus permits natural realignment of displaced discs and vertebrae which invariably occur due to the effects of crooked action as described above.

According to the invention, an equestrian training aid comprises a chain or other elongate flexible member adapted to be coupled, clipped or connected at each end to one of the side rings of a horse's bit, and one or more weights adapted to be carried by said elongate flexible member.

The chain and the weights carried thereon will rest in the so-called "chin groove" where the lower jaw meets the chin.

The amount of the weight carried should be enough to encourage a lowered head carriage, but not such as to impose excessive strain on the animal's neck muscles or to cause any distress. A plurality of say 10 ounce or 300 gramme weights may be used, and their number determined experimentally for the particular animal.

The weights may be enclosed in a soft resilient covering such as foamed rubber or plastics, or sheepskin. The length of the chain may be adjustable in use by moving the clips to different links of the chain to suit the jaw width of each particular horse.

A preferred embodiment of equestrian training aid according to the invention will now be described by way of example with reference to the accompanying drawings, wherein:

FIG. 1 is a perspective view of a snaffle bit fitted with the invention which constitutes an equestrian training aid.

Figure 1A:
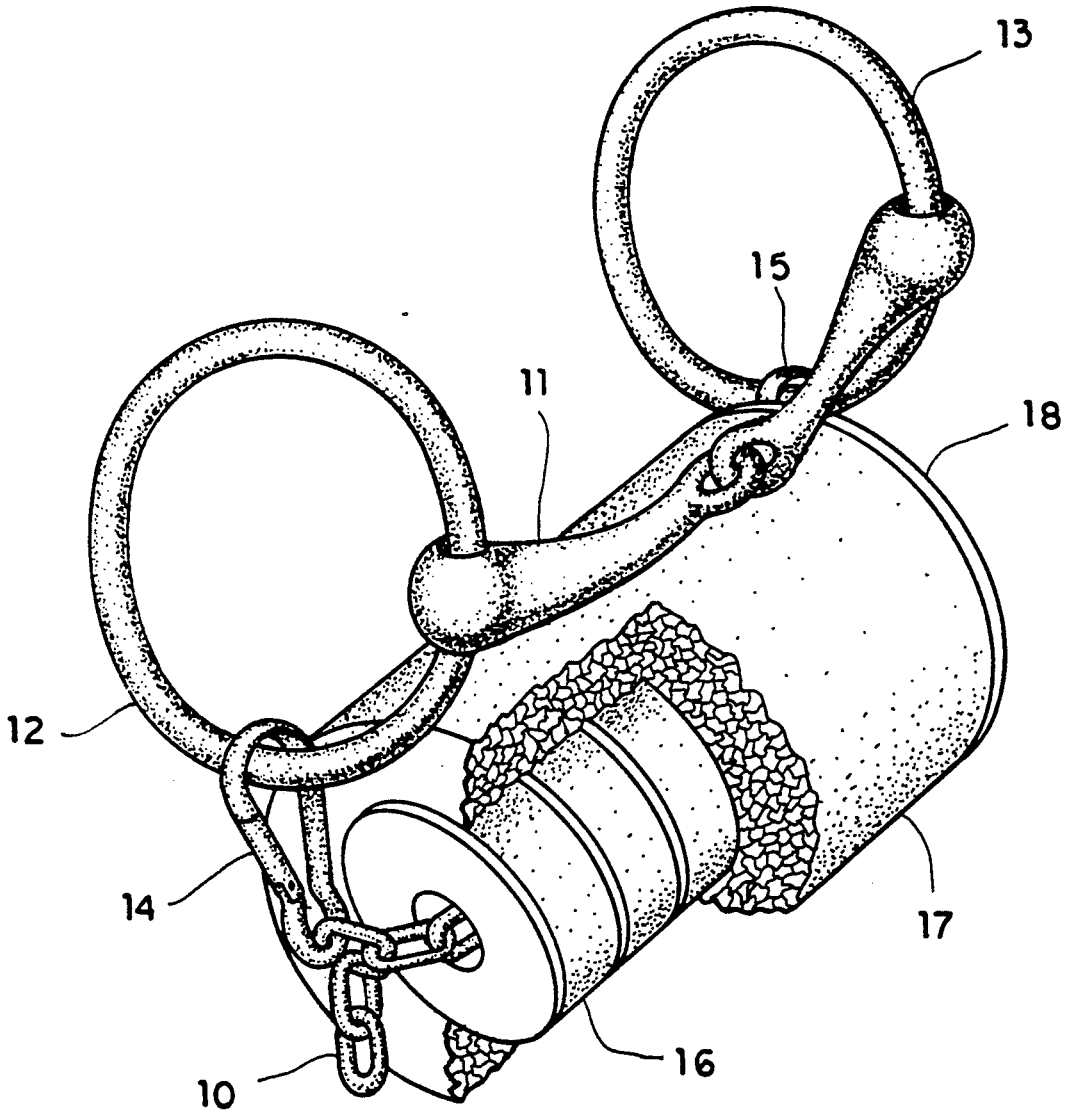
Figure 2:
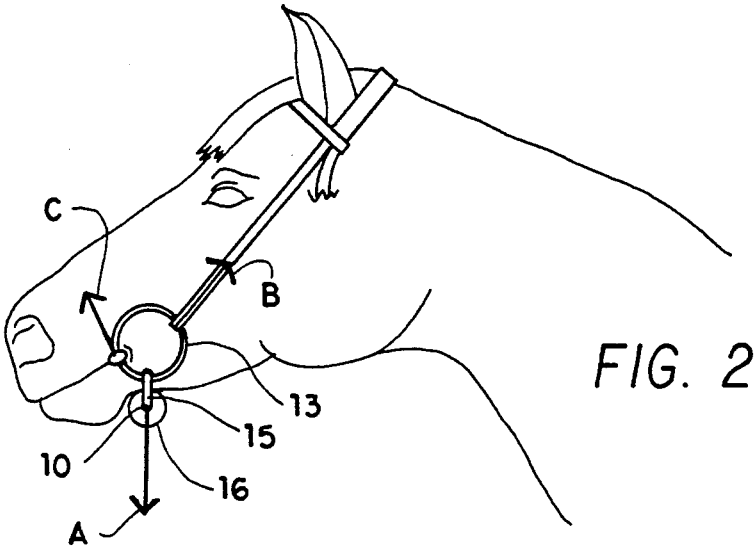
Figure 3:
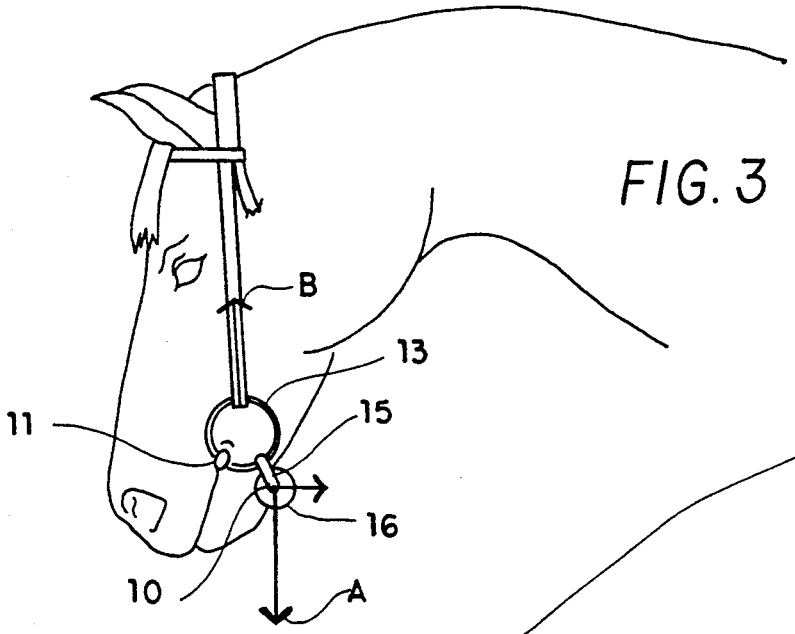
Figure 4:
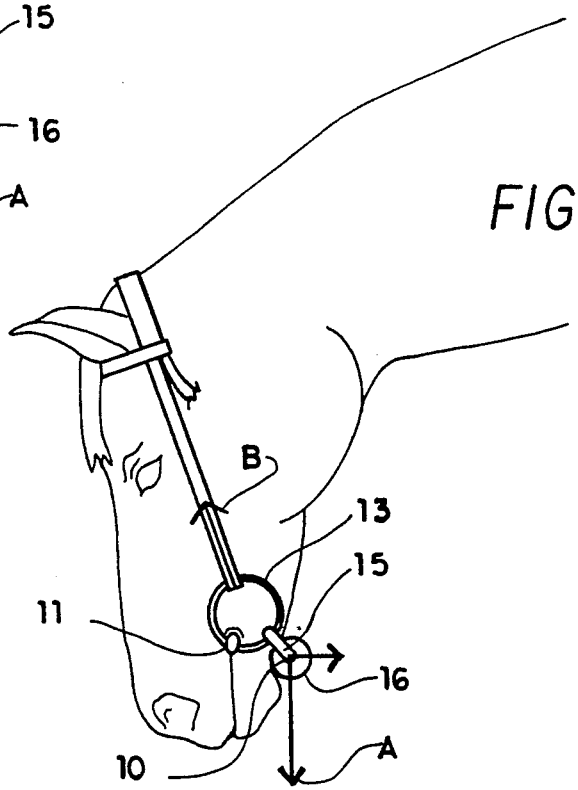

FIG. 1*a* is a modification of the construction of FIG. 1,

FIG. 2 is a diagram illustrating the forces acting with a horse's head and neck in an undesirably raised position, FIG. 3 is a similar diagram showing the horse's head lowered, and FIG. 4 is a similar diagram showing the head and neck in a preferred lowered position.

Referring first to FIG. 1 and FIG. 1*a*, the elongate flexible member or chain 10 is shown attached to a snaffle bit 11, on the side rings 12, 13 by means of releasable fastener means such as spring clips 14 and 15, one at or near each end of chain 10. The chain 10 comprises a plurality of serially attached elements or links 10*a* and is of such a length as to be positioned below the horse's jaw, in the chin groove behind the chin (FIGS. 2, 3 and 4) and would normally be attached to the side rings of the bit after the bridle and bit had been put on the horse.

Further the effective length of the chain may be adjusted by moving either or both of the clips to different links 10*a* of the chain, to suit the jaw width of each individual horse, and to ensure that the chain remains behind the chin.

The chain 10 carries a plurality of weights 16, in the form of cylindrical bodies with an axial hole through which the chain is threaded. Each weight 16 may for example be 10 ounces or 300 grammes, or other suitable incremental value. The number of weights and thus the total weight may be varied, as required, and if necessary found by experiment for each particular horse.

As shown in FIG. 1*a* the weights 16 are enclosed in a soft resilient cover 17 of foamed rubber or plastics or sheepskin as example. The cover 17 is shown cutaway for clarity and the assembly 16, 17 is contained between two end plates or discs 18, only one being shown here.

The use of the invention is illustrated in FIGS. 2–4. In FIG. 2 a horse is shown with its head in an incorrect, raised posture. In this position, if persisted with and habitual, the response to pressure on the bit is dulled, as the bit pulls into the corner of the mouth causing injury and scarring. Using the chain 10, weight is imposed on the bit, acting in the direction of arrow A. This imposes a load which is felt on the lower jaw, and the horse is encouraged to lower its head. Arrow B shows the direction of pull by the cheek strap of the bridle, and arrow C the reaction of the jaw.

In FIG. 3, the horse is shown with its head lowered into a more comfortable position, which is also better for control, as the reins pull the bit against the tongue and lower jaw rather than into the corner of the mouth. In this position the weights 16 rest against the chin and acting downwardly no longer pull the bit into the mouth. The weight is now transmitted to the crown of the head by the cheek straps of the bridle, and this is preferred by the horse, and quickly learned.

If the horse attempts to avoid this effect by overbending to go "behind the bit", the load does not go away and overbending will not be persisted in as a means of avoidance. The horse may thus carry his head in any position he wishes, and has freedom to move naturally and adjust his head and neck posture for balance etc., but with use chooses to adopt the desired position. This fulfils the first object of the invention.

In position FIG. 3 moreover with the load transmitted to the crown of the head, the horse is encouraged to lower his neck into the optimum combination of head and neck carriage as shown in FIG. 4. During work on the lunge with the invention fitted, it has been found that the horse will alternate between positions FIG. 3 and FIG. 4 without additional aids from the trainer thus fulfilling the second object of the invention. Furthermore, because the horse is carrying an additional weight, the rate of muscular development is enhanced compared with similar work in traditional training and the invention thus originates the concept of weight training for horses. As with weight training of humans, the amount of weight used and duration of training session may be increased as muscular ability and fitness improve.

As described above, the invention produces a head and neck carriage (FIG. 3 and FIG. 4) where the considerable load of head and neck is cantilevered in front of the front legs to produce a "moment" the sense of which being a rotation about the front feet. This is in no way an abnormal state for the horse and is described as being "extended". When in motion and extended the horse is compelled to reach well forward with the forelegs at each pace to maintain his equilibrium. Conversely, when head and neck are held up with the neck approaching the vertical, the stride is reduced and the action produces more vertical motion of the legs than forward motion. In simple terms this is undesirable in basic training, as the function of the horse is to cover ground, not to pace on the spot: if this is permitted incorrect muscular development occurs, accompanied by an increasingly confused mental state which in severe but by no means uncommon, cases, results in the horse becoming physically and mentally incapable of producing the normal paces.

Not only does the invention encourage the horse to extend, but also by applying an additional load to the cantilever of the horse's neck, produces even greater forward activity of the legs than would normally occur. When the forelegs are active thus, the hindlegs have to respond in a similar manner, and the horse is then working "through" correctly, which is the third object of the invention.

When the horse is working "through" correctly it is less able to favour the weaker aspects of its physiology and produce asymmetrical action and posture. Also in order to balance the additional (and thus "abnormal") load of the invention, the horse has to make a greater effort than normal with the underdeveloped areas, thus strengthening these areas. These comments are applicable to normal work with the invention. In cases of defective action which result in the horse working with his neck bent and head held to one side, possibly associated with incorrect tracking (i.e. the front and rear feet do not fall on one track; also known as "crabbing") the invention may be adapted to correct this fault. The chain is assembled with a normal or reduced set of weights such that the weights are placed close to the right hand or left hand clips and a third clip is fitted to the chain to retain the weights in this asymmetrical position.

When used thus the increased load on one side of the bit and bridle causes the horse to respond by correcting the head position by way of acceptance or resistance. The side to which the weights should be placed may be found immediately by trial. If necessary, an additional separate weight may be suspended from one ring of the bit in addition to the normal form of the invention. This effect comprises the fourth object of the invention.

It is essential that a horse does not learn to grasp the bit firmly between the jaws as when this occurs it is possible for him to evade the rein aids, become a "puller" and in extreme cases, able to "bolt" at will. During ridden training, the rider should always ensure a light contact on the bit by means of small aids which keep the bit mobile in the horse's mouth. Clearly it would be advantageous if this were to be reinforced during training on the lunge. As the invention is not tightly fitted, the weight will swing, in a limited manner, not only front to back, but also from side to side, thus keeping the bit mobile, which is the fifth object of the invention.

This fifth object in conjunction with the first object produces the most desirable combination of stimuli for the promotion of a soft responsive mouth able to respond to gentle rein aids to the benefit of control and the horse's well being.

Displacement of vertebrae and inter-vertebral discs is a common problem in horses and realignment is sometimes attempted by manipulation. Although this can be a success in the short term, the problem generally recurs as the causal physiological defect or defects have not been rectified. Prolonged periods of stretching and lowering the neck can allow natural relocation of displaced vertebrae and discs to occur. As this is achieved by the invention in conjunction with possible rectification of physiological defects the effect is not only more likely to endure, but also the "treatment" is applied daily to a horse in work thus ensuring a cumulative benefit, which is the sixth object of the invention.

The weights may conveniently be wrapped in a sheepskin or other soft cover, such as a tube of foamed rubber or plastics, in order to avoid chafing of the weights against the horse's chin, and a soft rubber or plastics disc may be provided at each end of the weights to retain the weights and close the tube. The disc may have a slotted axial hole to engage on the chain links.

The form of training aid described is the preferred form of the invention, but the scope thereof is not restricted thereto, and other embodiments are possible.

I claim:

1. An equestrian training aid comprising an elongate flexible member including a plurality of serially attached elements adapted to be joined respectively at each end to the two side rings of a horse's bit, a plurality of weights adapted to be carried by said elongate flexible member, releasable fastener means selectively attachable to various ones of said serially attached elements of said elongate flexible member and to each side ring of the horse's bit whereby, upon moving said releasable fastener means between alternate ones of said serially attached elements, a suitable fitting is achieved for the jaw width of a particular horse.

2. An aid according to claim 1 wherein said plurality of weights each are of an incremental unitary weight, and each in the form of a body of generally cylindrical or polygonal shape with an axial hole through which said elongate flexible member may be threaded.

3. An aid according to claim 2 wherein said elongate flexible member comprises a chain.

4. An aid according to claim 2 including a soft resilient cover substantially enclosing said plurality of weights.

5. An aid according to claim 4 wherein said cover includes a tubular member, and a disc at each end of said weights, to retain said weights and close said tubular member.

6. An aid according to claim 1 wherein said elongate flexible member comprises a chain.

7. An aid according to claim 1 including a soft resilient cover substantially enclosing said plurality of weights.

8. An aid according to claim 7 wherein said cover includes a tubular member, and a disc at each end of said weights, to retain said weights and close said tubular member.

9. A method of training horses in proper head and neck carriage comprising the steps of:

inserting a bit attached to two side rings into the horse's mouth.

placing a plurality of weights on an elongate flexible member having opposite ends, employing releasable fastener members to attach said elongate flexible member opposite ends respectively to said two side rings to position said weights on said elongate flexible member within the area of the horse's chin groove, and varying the mass of said weights until the horse exhibits the proper head and neck carriage being sought.

* * * * *